US008657998B2

(12) United States Patent
Lockhart et al.

(10) Patent No.: US 8,657,998 B2
(45) Date of Patent: Feb. 25, 2014

(54) METHOD AND APPARATUS FOR PARTICULATE REMOVAL FROM MOVING PAPER WEBS

(75) Inventors: Brad Scott Lockhart, Leesburg, GA (US); André Mellin, Amberley Village, OH (US); John Ferney McKibben, West Chester, OH (US); David Matthew Ogden, Cincinnati, OH (US); Brian Christopher Schwamberger, Fairfield Township, OH (US); Peter Wiedmann, Loveland, OH (US); Richard Matthew Giachetto, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 209 days.

(21) Appl. No.: 13/162,945

(22) Filed: Jun. 17, 2011

(65) Prior Publication Data

US 2012/0317742 A1 Dec. 20, 2012

(51) Int. Cl.
*B08B 5/00* (2006.01)

(52) U.S. Cl.
USPC ..... 162/272; 15/306.1; 15/309.1; 34/618; 34/621; 162/199

(58) Field of Classification Search
USPC ..... 15/306.1, 309.1, 309.2; 134/9, 15; 162/199, 272; 34/618, 621
See application file for complete search history.

(56) References Cited

U.S. PATENT DOCUMENTS

| | | | | |
|---|---|---|---|---|
| 2,515,223 | A * | 7/1950 | Hollick | 69/1 |
| 3,078,496 | A * | 2/1963 | Doran et al. | 15/346 |
| 3,587,177 | A * | 6/1971 | Overly | 34/641 |
| 4,838,603 | A | 6/1989 | Masoero et al. | |
| 4,905,500 | A | 3/1990 | Mason | |
| 4,906,333 | A | 3/1990 | Myren | |
| 4,932,426 | A * | 6/1990 | Wolff et al. | 134/16 |
| 4,934,016 | A * | 6/1990 | Kalin | 15/309.1 |
| 5,466,298 | A | 11/1995 | Pollock | |
| 5,577,294 | A * | 11/1996 | Pollock | 15/345 |
| 5,916,373 | A * | 6/1999 | Schneider | 134/15 |
| 6,148,831 | A * | 11/2000 | Lindstrom et al. | 134/21 |
| 6,457,204 | B1 | 10/2002 | Bauböck et al. | |
| 7,186,526 | B2 | 3/2007 | Fiddes et al. | |
| 2002/0096195 | A1 * | 7/2002 | Harvey et al. | 134/21 |
| 2007/0199577 | A1 * | 8/2007 | Mucke et al. | 134/1 |
| 2008/0060678 | A1 | 3/2008 | Featherston et al. | |

FOREIGN PATENT DOCUMENTS

| | | |
|---|---|---|
| EP | 520 145 | 12/1992 |
| JP | 2006219208 | 8/2006 |
| JP | 2008230787 | 10/2008 |
| WO | WO 01/76777 | 10/2001 |

* cited by examiner

*Primary Examiner* — Mark Spisich
*Assistant Examiner* — Andrew A Horton
(74) *Attorney, Agent, or Firm* — Wednesday G. Shipp; Roddy M. Bullock

(57) ABSTRACT

An apparatus for removing particulate-carrying air from a moving web. The moving web has a first side and a second side. The apparatus includes a NACA duct positioned in a non-contacting relationship on a first side of the moving web, and at least partially submerged in a particulate-carrying boundary layer of the moving web. The NACA duct can have an intake opening and an exhaust opening such that when the intake opening is submerged in the boundary layer at least a portion of the particulate-carrying air from the boundary layer enters the intake opening and exits the exhaust opening, thereby scavenging particulate-carrying air from said boundary layer.

10 Claims, 8 Drawing Sheets

METHOD AND APPARATUS FOR PARTICULATE REMOVAL FROM MOVING PAPER WEBS

FIELD OF THE INVENTION

The present invention relates to systems and apparatus for dust and other particulate removal from the boundary layer of moving webs, including nonwoven and paper webs.

BACKGROUND OF THE INVENTION

Paper machines, particularly machines making tissue paper such as toilet tissue, facial tissue, and paper towels, create substantial amounts of dust. Dust and other particulates gets carried in the boundary layer of a moving web but gets dislodged when the web is disturbed or changes directions. Dislodged dust that accumulates on the machinery can interfere with correct operation, lead to product quality problems in some circumstances, and can hinder or require maintenance. Additionally dust that is transferred into the air can also represent a fire hazard, and its inhalation can cause health problems for workers.

Much effort has been directed to the development of dust hoods for vacuuming dust laden air from parts of such machines. However, such devices are themselves imperfect in operation and can require substantial power consumption as well as being the source of noise.

One problem with methods involving vacuum applied to the web surface is that the vacuum, in addition to removing airborne fibers can partially dislodge fibers in the web, creating loose or loosened fibers which then can become airborne downstream from the vacuum area.

There is thus a continuing need for a method and apparatus for removing dust in a power-efficient, environmentally friendly manner.

SUMMARY OF THE INVENTION

An apparatus for removing particulate-carrying air from a moving web is disclosed. The moving web has a first side and a second side. The apparatus includes a NACA duct positioned in a non-contacting relationship on a first side of the moving web, and at least partially submerged in a particulate-carrying boundary layer of the moving web. The NACA duct can have an intake opening and an exhaust opening such that when the intake opening is submerged in the boundary layer at least a portion of the particulate-carrying air from the boundary layer enters the intake opening and exits the exhaust opening, thereby scavenging particulate-carrying air from said boundary layer.

DETAILED DESCRIPTION OF THE INVENTION

Figure 1A:
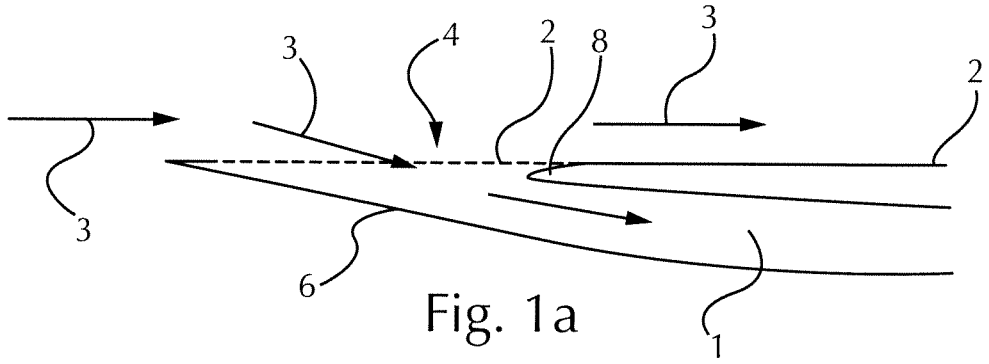
FIGS. 1*a* and 1*b* are schematic representations of a typical NACA duct.

In a typical paper machine for making absorbent tissue, such as bath tissue, facial tissue, or paper towels there is a drying section typically in which the paper web is adhered to the surface of a rotating Yankee dryer and lead to a creping doctor blade. There, the web is creped off the Yankee dryer by the creping blade. The creped paper web can then be wound onto a reel, which is often referred to as a parent roll. At creping, and in other parts of the dry paper-making path, dust separates from the paper web. Part of this dust will be entrained in a boundary layer on each side of the creped web that can run forward at a velocity close to 25 m/s. This dust can become dislodged from the boundary layer and accumulate on the machinery. This accumulation can interfere with correct operation, lead to product quality problems, hinder maintenance, and may also present a fire hazard. Dust that is transferred into the air can also represent a fire hazard, and additionally can be breathed by workers.

Similar problems with respect to dust and particulate creation and its removal are observed also in the converting of such paper webs, as well as in the manufacture and converting of other webs like nonwovens and other webs made of filaments.

Accordingly, whereas the present invention can find beneficial application for removal of particulate-carrying air, including dust-laden air, on various web production and conversion applications, the invention will be described below primarily in its operates for catching and extracting at least a portion of the dust-laden air in a boundary layer of a moving paper web. Removal of particulate-carrying air, including dust-laden air, can be described as scavenging.

The invention utilizes a NACA duct. NACA ducts are well known for the purpose of drawing off boundary layer air in moving vehicles without disrupting airflow otherwise. The design and construction of NACA ducts are well-known, for example, a description of NACA ducts can be found in the October 1945 National Advisory Committee for Aeronautics Advance Confidentiality Report #5I20 (NACA ACR No. 5i20) "An Experimental Investigation of NACA Submerged-Duct Entrances" by Charles W Frick, Wallace F. Davis, Lauros M. Randall, and Ernest A Mossman. This document is available on the internet as a downloadable web archive PDF file at http://naca.central.cranfield.ac.uk/report.php-?NID=2176.

Characteristic for a NACA-duct is an intake opening having a curved and divergent contour. The part of the intake opening which is submerged in the boundary layer can be configured as a ramp-like surface having an angle relative to an outer surface reference, such as, in the instant application, a moving web. There can be a sharp edge transition in between the outer surface reference and the inner ramp-like surface. A NACA duct contains as well an inlet profile adjacent the air intake. NACA duct functionality is based on the principle of generating rotating air vortices on the opening edges of the air intake, which help guide the boundary layer into the duct.

In the present invention the term "NACA duct" includes NACA ducts having curvilinear-shaped intake opening sidewalls, including curvilinear-shaped according to the dimensions disclosed in the above-mentioned October 1945 National Advisory Committee for Aeronautics Advance Confidentiality Report. As used herein, the term NACA duct also includes ducts having substantially straight intake opening sidewalls. Ducts having substantially straight intake opening sidewalls can approximate NACA ducts having curvilinear-shaped intake opening sidewalls. In plan view, in a substantially straight walled version, the substantially straight sidewalls of a NACA duct form a trapezoidal shape, with opposite lengthwise sidewalls diverging from a relatively short upstream wall to a relatively long downstream wall.

FIG. 1*a* shows a sectional view of a typical NACA air intake. An intake opening 4 extends down to a ramp-like inlet surface 6. An airduct 1 joins the ramped inlet surface 6 with a profiled edge 8 and directs the air from the environment into this airduct. The airflow 3 passes the intake opening 4 and enters the airduct 1, with only minimal disturbance of the airflow.

Figure 1B:
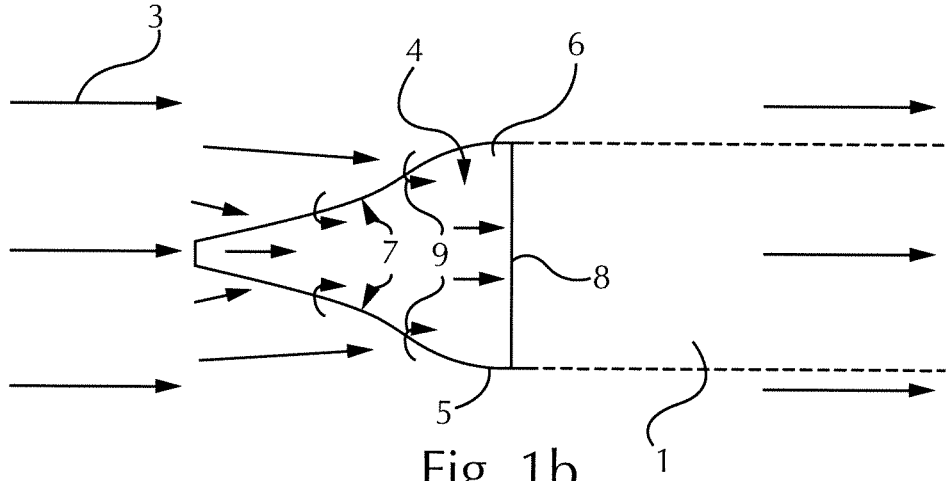

FIG. 1*b*. shows a top view of the opening 4. The divergent opening contour 5 is apparent, where the ramped inlet surface 6 has typically the same contour. Vertical sidewalls 7 of the opening 1 defined by the contour of the opening 5 and the ramped inlet surface 6 are primarily perpendicular to the base surface 2. The airflow 3 passes the opening 4 and enters by the formation of counter rotating vortices 9 in the airduct 1.

Figure 2:
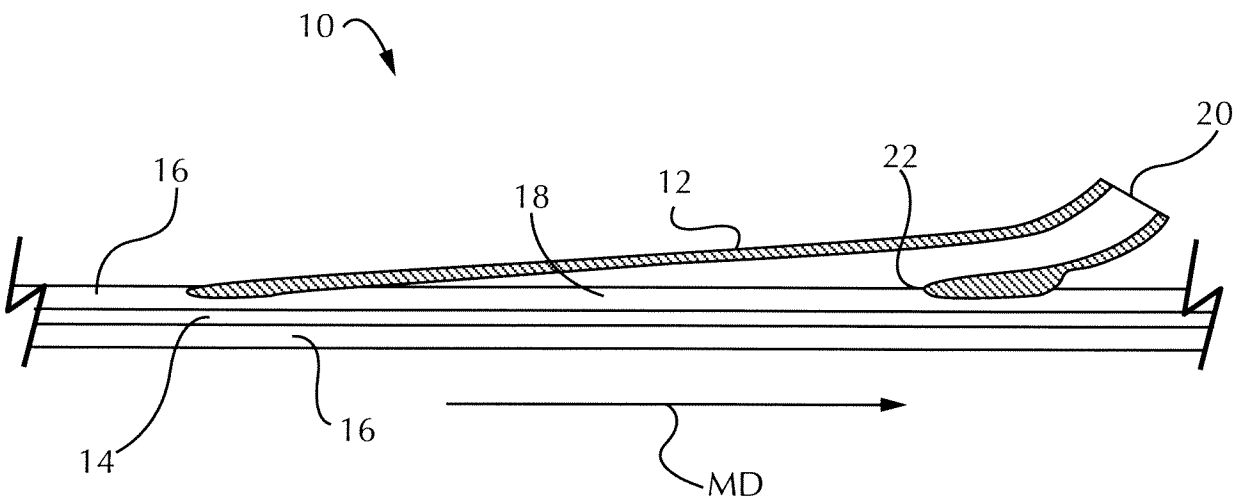
FIG. 2 is a side view of one embodiment of an apparatus of the present invention.

In an embodiment of the invention shown in FIG. 2, a system and apparatus 10 of the present invention includes a NACA duct 12 in operational proximity to a moving web 14. NACA duct 12 is shown in cross-section to better indicate its operation. Moving web 14 has a boundary layer 16 on each side thereof, the boundary layer having a thickness related to the speed of the moving web by well known equations relating to the Reynolds number of air. For current processes on commercial paper machines, the boundary layer for a paper web running at about 700 m/min can be from about 1 mm to about 25 mm thick, i.e., the boundary layer can extend from 1 mm to about 25 mm perpendicularly from the surface of the web 14. The boundary layer can be about 5 mm, 7 mm, 9 mm, 11 mm, 13 mm, 15 mm, 17 mm, 19 mm 21 mm or 23 mm thick.

NACA ducts have an intake opening 18 (corresponding to intake opening 4 of FIG. 1*a*) having walls that diverge in increasing cross-sectional area to an exhaust opening 20 having greater cross-sectional area than the intake opening. A smooth, rounded edge 22 allows a smooth transition of air passing the NACA duct, permitting some of the boundary layer to smoothly enter toward exhaust opening 20, and some of the air to pass relatively undisturbed. As the boundary layer traverses the intake opening it is guided over the angularly oriented diverging walls to create rotating vortices directed away from the web. These rotating vortices carry dust-laden air to the exhaust opening. A NACA duct positioned for effective operation to effectively remove a portion of the air of a boundary layer of a moving web can be said to be disposed in operation relationship to the moving web.

In an embodiment dust removal can be aided by a partial pressure, such as by vacuum, at the exhaust opening 20. Vacuum can be supplied via known vacuum means, and can be balanced such that the mass balance of air entering the intake opening and air exiting the exhaust opening remains substantially equal. A vacuum generating apparatus can be situated relatively closely to exhaust opening, or exhaust can be effected via ductwork and/or manifolds such that the vacuum generating apparatus can be situated remotely and supply vacuum via the ductwork and/or manifolds.

A NACA duct 12 is positioned in operational proximity to the moving web, which means the NACA duct is positioned in a non-contacting relationship to the paper web moving in a machine direction (MD), and that its inlet 18 is submerged in the dust-carrying boundary layer 16 with the narrowest portion of the intake opening being positioned upstream with respect to the MD. When positioned in operational proximity there is no direct contact with the moving web and no normal forces are applied to the web by the NACA duct, both conditions of which tend to produce more dust by virtue of disturbing fibers on the web. For example, normal forces applied by vacuum or shear forces from web-contacting components contacting a moving web can partially dislodge fibers that later become airborne, or fully dislodge fibers that are not removed upon separation from the web. Further, web-contacting portions of web handling equipment, including dust-removal equipment, disrupts the laminar flow of the boundary layer, causing additional dust-laden air to be directed out of the boundary layer. Dust from such re-directed dust-laden air can then settle on equipment or remain airborne as an environmental concern.

Figure 3:
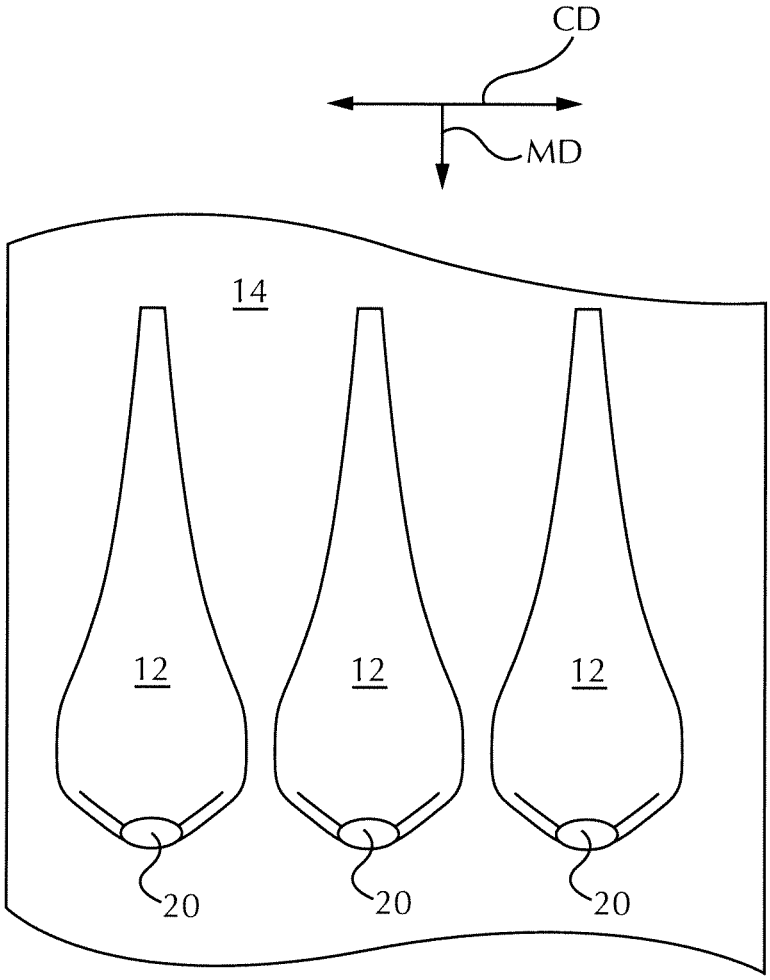
FIG. 3 is a top view of one embodiment of an apparatus of the present invention.
Figure 4:
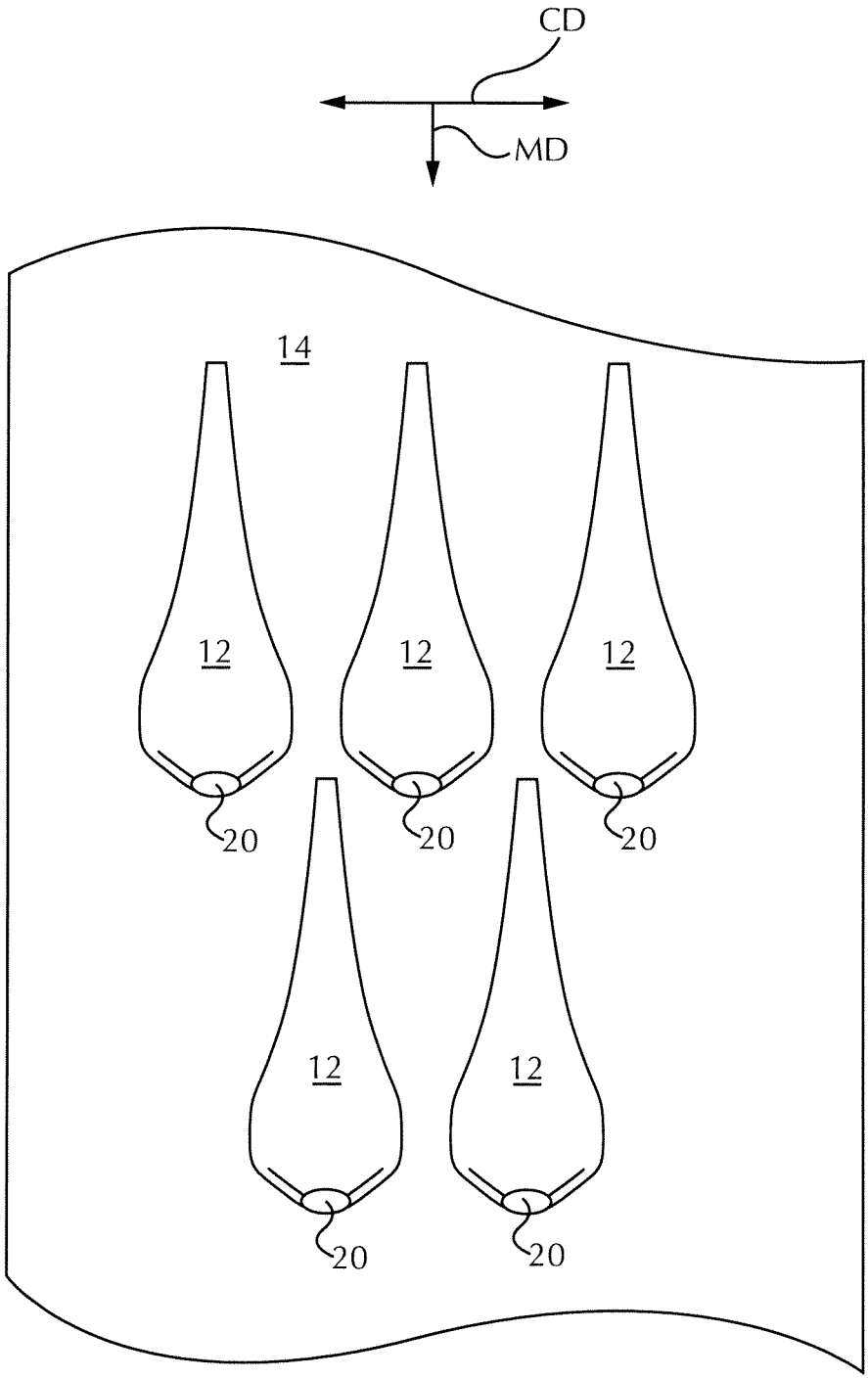
FIG. 4 is a top view of one embodiment of an apparatus of the present invention.
Figure 8:
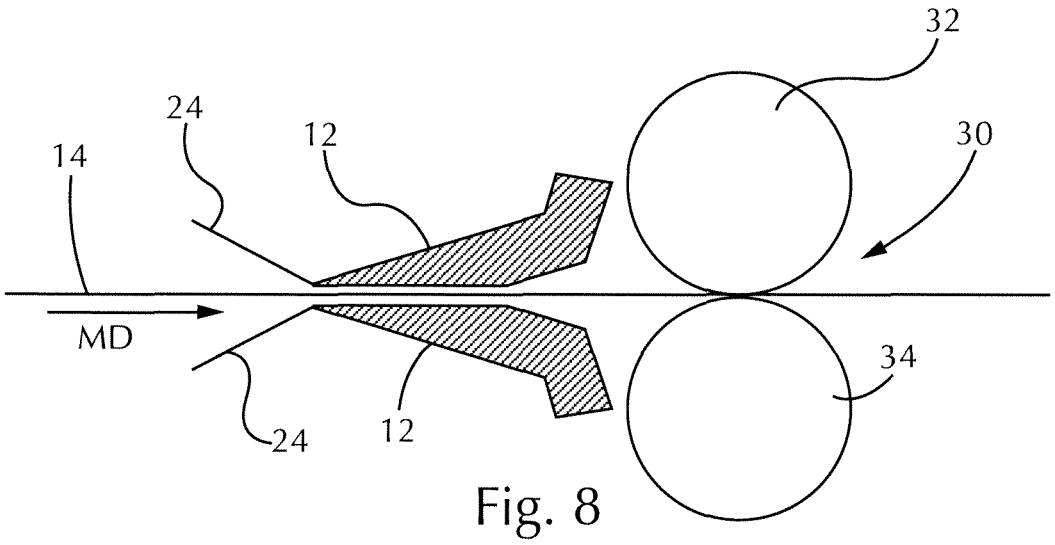
FIG. 8 is a side view of one embodiment of an apparatus of the present invention.
Figure 9:
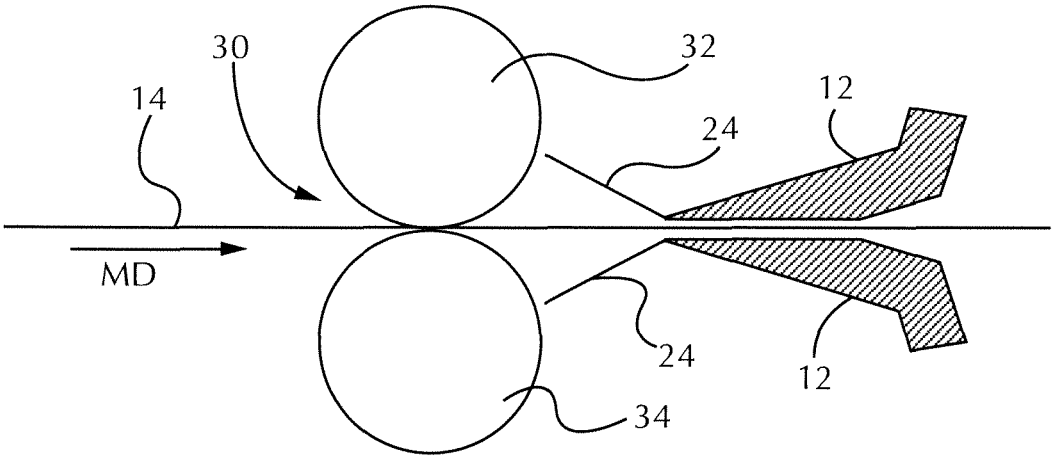
FIG. 9 is a side view of one embodiment of an apparatus of the present invention.

Although FIG. 2 shows a NACA duct on only one side of a moving web, a NACA duct can be placed on both sides of a moving web as shown in FIGS. 8 and 9, described in more detail below. In addition, as shown in FIGS. 3 and 4, a plurality of NACA ducts can be utilized. In the embodiment shown in FIG. 3, a series of closely spaced NACA ducts 12 can be disposed across a portion of the width of web 14, and can be disposed substantially across the entire width of web 14.

Because the widest portion of the intake opening 18 of each NACA duct can be relatively narrow in a direction corresponding to the width, or cross direction (CD) of web 14, in another embodiment, as shown in FIG. 4, a plurality of NACA ducts 12 can be staggered in CD-oriented rows of substantially side-by-side NACA ducts 12, thereby increasing the area of total web boundary layer impacted by the NACA ducts. While two CD-oriented rows are shown in FIG. 4, in other embodiments, more than two CD-oriented rows can be employed as desired. In general, the size and spacing of NACA ducts 12 can be selected to ensure substantially 100% of the CD of the web 14 is covered by a NACA duct intake opening 18.

Figure 5:
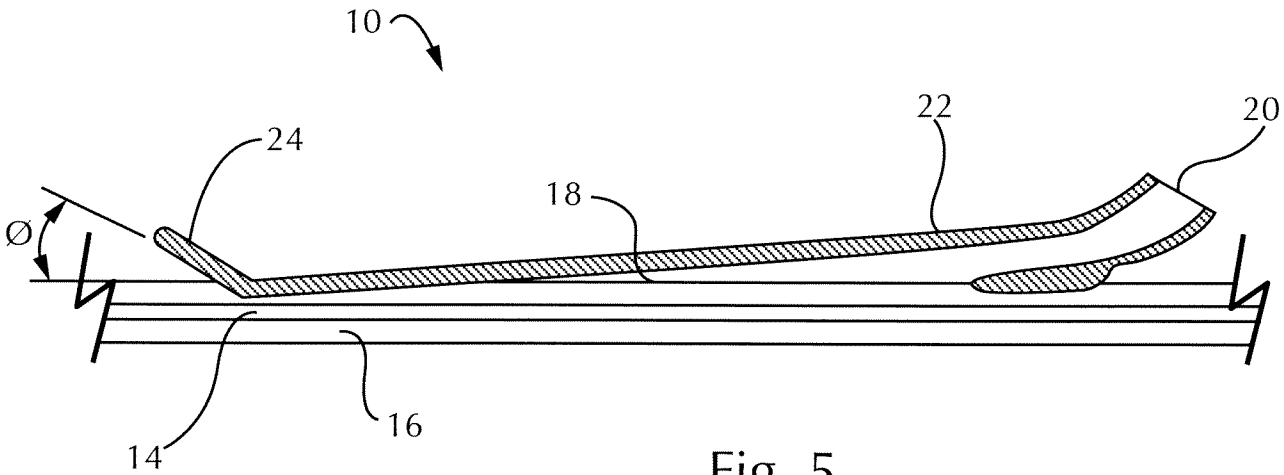
FIG. 5 is a side view of one embodiment of an apparatus of the present invention.

As shown in FIG. 5, in an embodiment, the NACA duct 12 can have on its upstream edge a converging plate 24 that can span in a width-wise dimension at least the width of intake opening 18. Converging plate 24 can have sufficient length and can be angled sufficiently with respect to the plane of moving web 14 such that leading edge 22 can be outside of the boundary layer. In general angle $\theta$ can be from about 10° to about 50°. Converging plate 24 enhances the operation of the NACA duct by smoothly diverting more of the boundary layer into intake opening 18.

Figure 6:
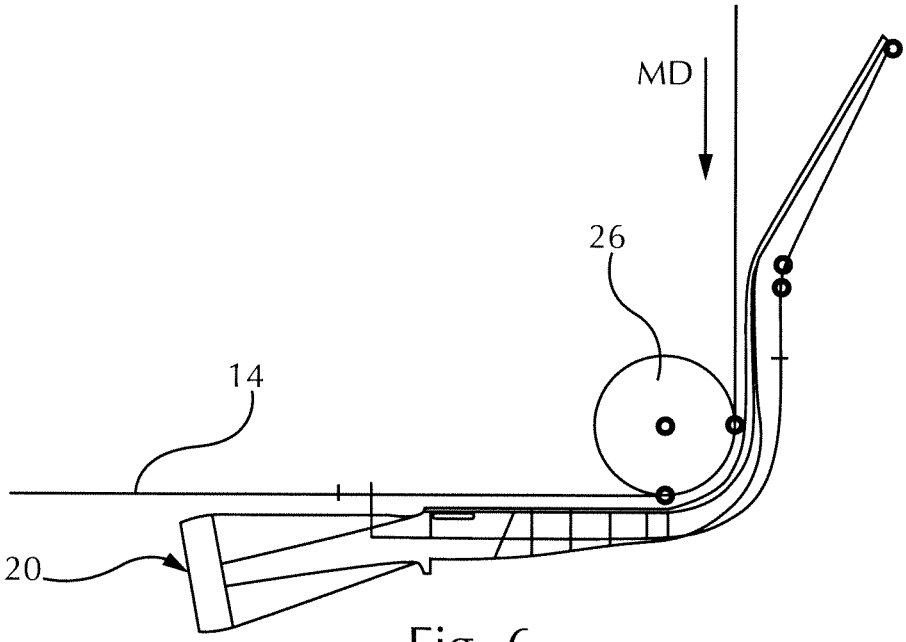
FIG. 6 is a side view of one embodiment of an apparatus of the present invention.

In an embodiment, the dust removal system and apparatus of the present invention can be utilized at a position of the web path in which the web is turning over a roller. A moving web going over a roller can be more stable, e.g., less prone to flutter, than a web spanning a free span. The added web stability imparted by a moving web in tension traversing a roller can be beneficially utilized by the NACA duct of the present invention by allowing the NACA duct to be placed closer to the web surface without inadvertently contacting the web surface. Additionally, the centrifugal forces imparted on the particles on the outer surface of the web will increase the effectiveness of this arrangement. As shown in FIG. 6, moving web 14 can move in a machine direction (MD) over a roller 26 such that the web path is changed. The change in web path can be from 10° to about 180°. A NACA duct 12 can have a shape such that the NACA ducts can conform substantially to the curvature of the web 12 around roller 26.

Figure 7:
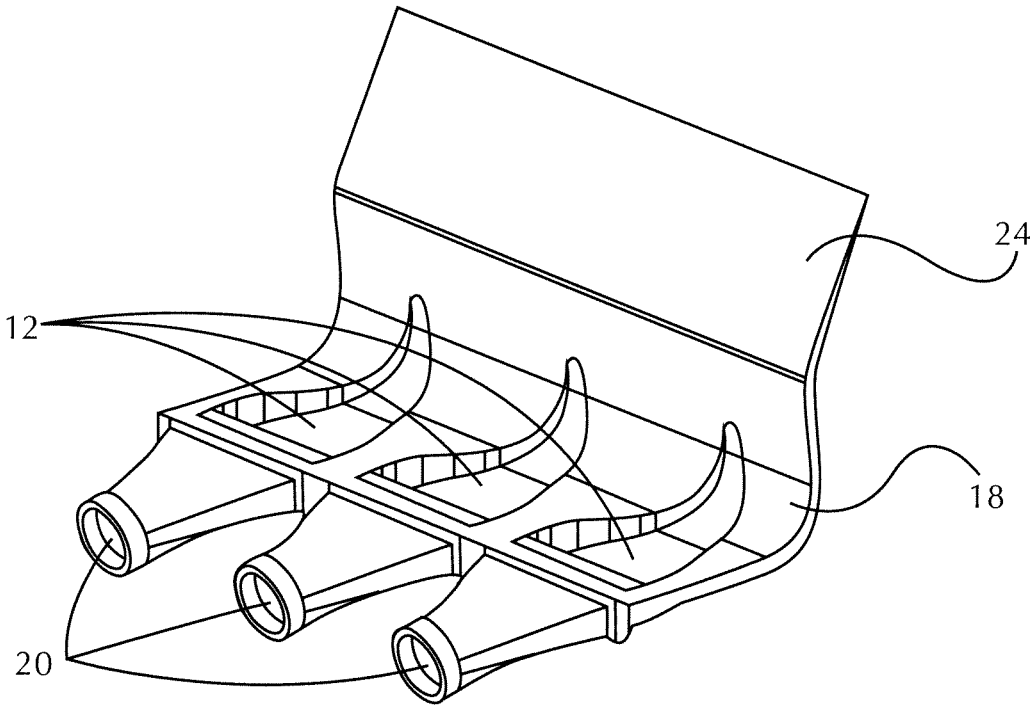
FIG. 7 is a perspective view of an embodiment of a NACA duct of the present invention.

An embodiment of a NACA duct, specifically a NACA duct 12 as depicted in FIG. 6, is shown in FIG. 7. FIG. 7 shows a NACA duct 12 from a perspective of looking at the web-facing surface. Three NACA ducts 12 are shown in a substantially side-by-side relationship. FIG. 7 shows the convergence plate 24, the diverging sidewalls of each intake opening 18, as well as the exhaust openings 20. Although FIG. 7 shows a curved version of the NACA ducts 12 of the present invention, the same structure(s) is/are present in a flattened version, as depicted in FIG. 2.

In an embodiment of the invention, FIG. 8 shows an arrangement of two NACA ducts 12, one on each side of a moving web 14, the web 14 moving into a nip roll arrangement 30. Nip roll arrangement 30 has two rolls, 32 and 34 between which web 14 traverses. Nip rolls 32 and 34 can be calendar rolls, emboss rolls, or any other of typical nip rolls used in web forming processes. The advantage of placing NACA ducts before a web enters the nip of nip rollers is that the dust-laden air in the boundary layer can be scavenged before the boundary layer is disrupted by the nip roll arrangement 30.

In another embodiment of the invention, FIG. 9 shows an arrangement of two NACA ducts 12, one on each side of a moving web 14, the web 14 moving away from a nip roll arrangement 30. Nip roll arrangement 30 has two rolls, 32 and 34 between which web 14 traverses. Nip rolls 32 and 34 can be calendar rolls, emboss rolls, or any other of typical nip rolls used in web forming or converting processes. These types of process typically liberate new dust from the web material which is then carried within the newly formed boundary layer after the nip. The advantage of placing NACA ducts after a web exits the nip of nip rollers is that this new dust that enters the boundary layer can be scavenged shortly after a new boundary layer forms after the nip roll arrangement 30.

Figure 10:
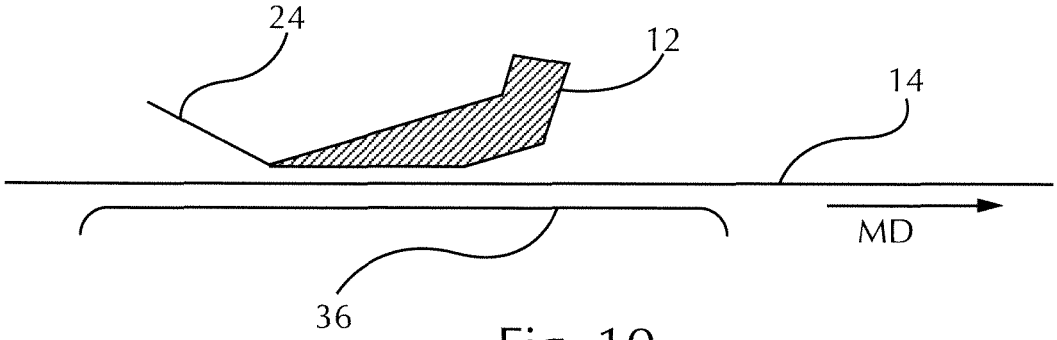
FIG. 10 is a side view of one embodiment of an apparatus of the present invention.

In another embodiment of the invention, FIG. 10 shows an arrangement of a NACA duct 12 in operative relationship to a first side of a moving web 14. On the other, second, side of the moving web 14 is disposed a dimpled plate 36, the dimpled plate being of sufficient size, design, and placement with respect to the web, as is known in the art, to ensure better controlled web handling. A dimpled plate on the opposite of web 14 from NACA duct 12 can stabilize the web, helping to prevent flutter and other web movement in an unsupported span, for example.

Figure 11:
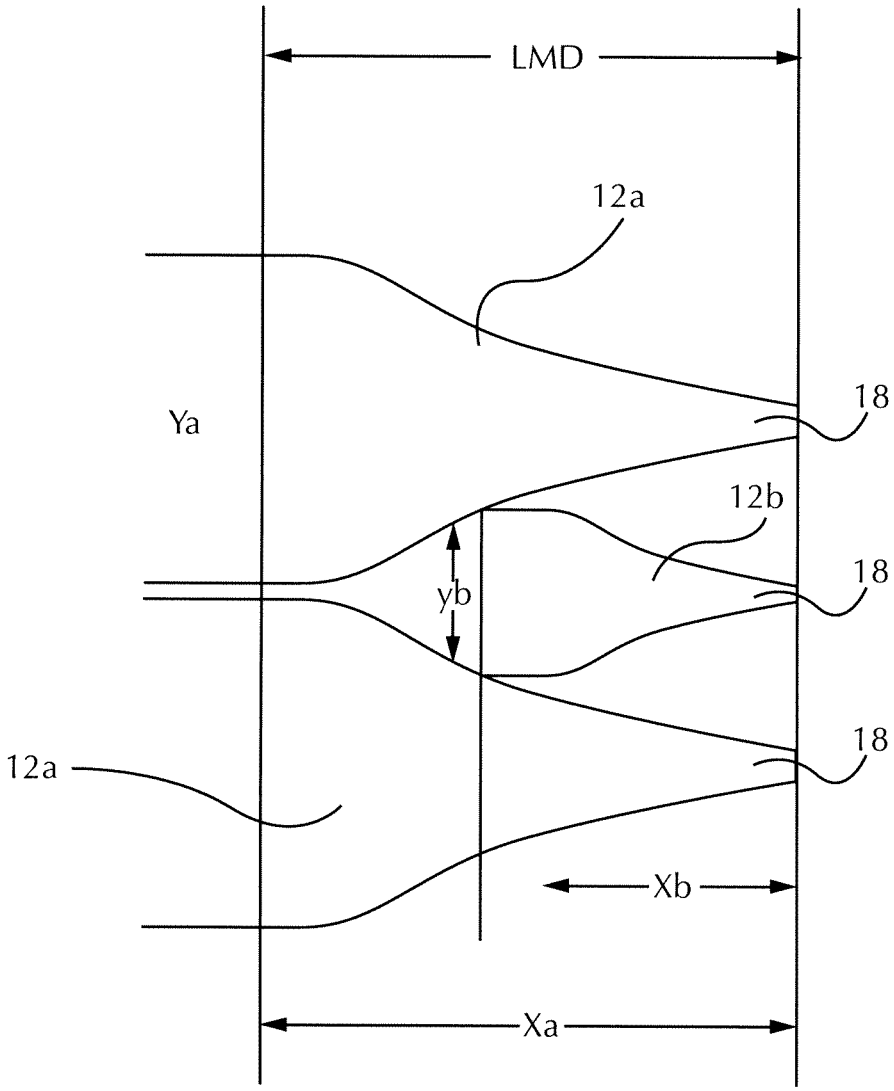
FIG. 11 is a diagrammatic representation of a nested NACA duct arrangement.

In an embodiment, the size of a plurality of NACA ducts arranged generally in the CD web direction can be modified to get substantially full CD web coverage while utilizing a minimum length of total web coverage in the MD direction, LMD. By optimizing the sizes of the plurality of NACA ducts to minimize LMD, full web particulate collection can be utilized at any web span of greater length than LMD. As shown in the diagram of FIG. 11, it is believed that by disposing a plurality of primary NACA ducts 12*a* in an adjacent side-by-side relationship, and by placing a half-size secondary NACA duct 12*b* between each primary NACA duct 21*a* such that the leading edge of all the intake openings 18 lie substantially on the same CD-oriented line, coverage for particulate collection can be maximized. Such a staggered, nested relationship of NACA ducts can minimize the space requirements for full-web-width dust collection.

As shown in FIG. 11, length Xa of the intake openings 18 of NACA ducts 12*a* can be twice the length Xb of the intake openings 18 of NACA duct 12*b* and the width Ya of the intake openings 18 of NACA ducts 12*a* can be twice the width Yb of the intake openings 18 of NACA duct 12*b*. In the configuration shown and described, maximum nesting of NACA ducts can be achieved. In general, the length Xb of the intake openings 18 of NACA ducts 12*b* can be about 30% to 80% the length Xa of the intake openings 18 of NACA duct 12*a* and the width Yb of the intake openings 18 of NACA ducts 12*b* can be about 30% to 80% the width Ya of the intake openings 18 of NACA duct 12*a*.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for removing particulate-carrying air from a moving web, the moving web having a first side and a second side, the apparatus comprising:

a. a plurality of NACA ducts disposed on said first and second sides of said moving web, wherein said plurality of said NACA ducts are disposed generally linearly across a width of said first and second sides and disposed generally linearly across the width of at least said first side of said web in a staggered, nested relationship;

b. wherein at least one NACA duct is positioned in a non-contacting relationship on the first side of the moving web and at least partially submerged in a particulate-carrying boundary layer of the moving web;

c. said at least one NACA duct having an intake opening and an exhaust opening such that when said intake opening is submerged in said boundary layer at least a portion of said particulate-carrying air from said boundary layer enters said intake opening and exits said exhaust opening, thereby scavenging particulate-carrying air from said boundary layer.

2. The apparatus of claim 1, further comprising means for generating a partial pressure at said exhaust opening, thereby actively assisting scavenging the particulate-carrying air from said boundary layer.

3. The apparatus of claim 1 further comprising:

at least a first roller over which the moving web can traverse, said web moving at a sufficient rate to produce the particulate-carrying boundary layer.

4. The apparatus of claim 1, wherein said particulate-carrying air is passively scavenged.

5. The apparatus of claim 1, additionally comprising vacuum means in operational proximity to said exhaust opening to effect a partial pressure at said exhaust opening.

6. The apparatus of claim 3, wherein said web is moving at a rate sufficient to produce the boundary layer at least about 1 mm thick.

7. The apparatus of claim 3, wherein said web changes velocity while traversing said first roller, said velocity change being at least due to a change in web direction as at least the first side of said web traverses said first roller.

8. The apparatus of claim 3 additionally comprising providing a second roller, said web traversing a nip between said first roller and said second roller.

9. The apparatus of claim 8, wherein said at least one NACA duct is disposed upstream of said nip.

10. The apparatus of claim 8 wherein said plurality of NACA ducts is disposed in one or both of before and after said nip.

* * * * *